United States Patent [19]

Coty

[11] Patent Number: 5,054,245

[45] Date of Patent: Oct. 8, 1991

[54] COMBINATION OF CLEANING PADS, CLEANING PAD MOUNTING MEMBERS AND A BASE MEMBER FOR A ROTARY CLEANING MACHINE

[75] Inventor: Dominique Coty, Philadelphia, Pa.

[73] Assignee: The Butcher Company, Marlborough, Mass.

[21] Appl. No.: 557,231

[22] Filed: Jul. 25, 1990

[51] Int. Cl.[5] ..... B24B 23/02; A47L 11/47

[52] U.S. Cl. ..... 51/170 R; 51/177; 51/363; 15/98

[58] Field of Search ..... 51/170 R, 170 T, 174, 51/177, 358, 363, 209, 389; 15/98, 49.1, 50.1

[56] References Cited

U.S. PATENT DOCUMENTS

| | | | |
|---|---|---|---|
| 1,141,287 | 6/1915 | Thayer | 51/177 |
| 2,225,193 | 12/1940 | Benner et al. | 51/209 R |
| 2,997,816 | 8/1961 | Hoyet et al. | 51/209 R |
| 3,357,141 | 12/1967 | Annis, Jr. | 51/176 |
| 3,518,709 | 7/1970 | Zemke et al. | 15/4 |
| 3,550,179 | 12/1970 | Brown et al. | 15/230 |
| 3,631,635 | 1/1972 | Vezner | 51/177 |
| 3,875,703 | 4/1975 | Clemente | 51/170 T |
| 3,946,692 | 3/1976 | Sierra et al. | 114/222 |
| 3,981,106 | 9/1976 | Gallo | 51/358 |
| 4,219,898 | 9/1980 | Presby | 51/177 |
| 4,319,434 | 3/1982 | Brejcha | 51/177 |
| 4,418,438 | 12/1983 | Cutler | 15/230 |
| 4,558,542 | 12/1985 | Marton | 51/358 |
| 4,609,581 | 9/1986 | Ott | 51/358 |
| 4,617,767 | 10/1986 | Ali | 51/358 |
| 4,691,403 | 9/1987 | Scharf | 15/114 |
| 4,724,567 | 2/1988 | Rones | 15/98 |

*Primary Examiner*—Roscoe V. Parker

*Attorney, Agent, or Firm*—Panitch Schwarze Jacobs & Nadel

[57] ABSTRACT

A combination of cleaning pads, cleaning pad mounting members and a base member for a rotary cleaning machine. A base member is attached to a drive shaft of the rotary cleaning machine. A plurality of generally pliable mounting members are releasably secured to the base members by a nut and bolt arrangement. The cleaning pad mounting members each have a first end for being releasably secured to the base member and a second end for securably receiving a cleaning pad thereon. A cleaning pad having a mounting surface and a cleaning surface is releasably secured to the second end of each of the cleaning pad mounting members by hook and loop material.

7 Claims, 2 Drawing Sheets

COMBINATION OF CLEANING PADS, CLEANING PAD MOUNTING MEMBERS AND A BASE MEMBER FOR A ROTARY CLEANING MACHINE

FIELD OF THE INVENTION

The present invention relates to a cleaning disk and, more particularly, to a combination of cleaning pads, cleaning pad mounting members and a base member for a rotary floor cleaning machine used for cleaning marble, granite and terrazzo floors.

BACKGROUND OF THE INVENTION

It is well known that when a marble, granite or terrazzo floor is first installed, it has a beautiful and attractive shine. However, after a short period of time, the floor becomes scratched, scuffed and dulled. In the maintenance or restoration of marble, granite or terrazzo floors, a variety of power-driven implements have been utilized to facilitate scrubbing and cleaning of relatively large floor areas to bring back the original crystalline finish.

One popular machine for such maintenance or restoration work, is a rotary scrubbing or buffing machine. Such a machine is shown in FIG. 1, and generally includes an electric motor, a handle extending at an angle upwardly toward the operator from a motor housing, a holding tank, which contains cleaning fluid, positioned on or above the motor housing and a scrubbing, polishing disk or base member attached to the motor drive shaft beneath the motor.

The disk or base member usually includes a cleaning pad or bonnet disposed thereon. This pad bears directly on the floor and applies the cleaning fluid thereto. The combined rotational, lateral and forward movement of the pad performs the cleaning and scrubbing action.

Conventional pads or cleaning disks are more or less of mop-like or shag-like consistency, in that the surface which bears on the floor is relatively soft and yielding. The trouble with such conventional pads is that they lack the aggressive stripping and scrubbing means which are necessary to perform an effective cleaning action. Such conventional pads are about as effective as using a standard mop over the hard floor surface, no worthwhile deep cleaning action is achieved.

More recently, pads have been provided with firmer surfaces, these pads are made by tightly looping strands of strong synthetic material through a base sheet of material. The resulting pad is much like a hooked rug as its working surface is firm. The firmer surface more actively cleans the floor and loosens a considerable amount of unwanted material. However, such pads are problematic because they do not restore the crystalline finish to the marble, granite or terrazzo floors. Moreover, since these types of pads lack aggressive scrubbing action, it is often necessary to use dangerous toxic or strong chemicals in the cleaning fluid to assist in the removal of material from the floor.

Attempts to resolve the lack of aggressive scrubbing action in the conventional cleaning pads yielded a cleaning pad with a diamond grit surface. The diamond grit surface is particularly effective in restoring a marble, granite or terrazzo floor to its original crystalline finish. However, such diamond grit pads have disadvantages because they are expensive and not easily mounted to the base member of the rotary cleaning machine.

A conventional method for mounting a diamond grit pad to a base member, includes permanently securing a neoprene rubber layer to the base member with epoxy. The diamond grit pad is then permanently secured to the neoprene rubber layer with epoxy also. This type of mounting system is problematic in that once the diamond grit pad wears out the entire base member, neoprene rubber layer and diamond grit pad must be replaced. Furthermore, to change between a course or fine diamond grit pad, the entire combination must be replaced. Thus, this conventional combination for mounting diamond grit pads is prohibitively expensive and cumbersome to use.

This system is also expensive because the diamond grit pad often spans the entire cleaning surface or area of the neoprene rubber layer thereby increasing the cost of the diamond grit pad itself. The conventional diamond grit pad mounting method is also problematic in that the epoxy fails to hold the base member, neoprene rubber layer and diamond grit pad together because of the rotational, lateral and forward movement of the cleaning disk in the wet environment. Therefore, such conventional cleaning disks often come unglued after a certain amount of usage. Consequently, a need has arisen for a cleaning disk for a rotary floor cleaning machine which can securely but releasably receive a plurality of relatively small diamond grit pads for efficiently and economically cleaning hard to restore floors, such as marble, granite or terrazzo floors.

The present invention overcomes many of the inherent disadvantages in the above-mentioned cleaning disks or pads. The present invention provides a base member to be secured to the rotary floor cleaning machine which includes a plurality of pliable cleaning pad mounting members releasably secured thereto by a nut and bolt arrangement. A corresponding plurality of cleaning pads having a diamond grit cleaning surface are secured to each of the cleaning pad mounting members by a hook and loop material. Such a combination yields a cleaning disk which achieves restoration of marble, granite and terrazzo floors to their original crystalline finish. Moreover, such a cleaning disk is economically efficient since a relatively small area of diamond grit surface is utilized, and the diamond grit pads can be changed or replaced without having to replace the entire disk. Thus, the cleaning disk of the present invention restores marble, granite and terrazzo floors to their original crystalline finish in an economical manner.

SUMMARY OF THE INVENTION

Briefly stated, the present invention comprises a combination of cleaning pads, cleaning pad mounting members and a base member for a rotary cleaning machine. The combination comprises a base member for attachment to a drive of the rotary cleaning machine. A plurality of generally pliable cleaning pad mounting members are releasably secured to the base member. The cleaning pad mounting members each have a first end for being releasably secured to the base member and a second end for securably receiving a cleaning pad thereon. First securing means is provided for releasably securing each of the cleaning pad mounting members to the base member. A corresponding plurality of cleaning pads are provided and have a mounting surface and a diamond grit cleaning surface. A cleaning pad is releasably secured to the second end of each cleaning pad mounting member. Second securing means is interconnected between the cleaning pad mounting surface and each cleaning pad mounting member second end for releasably securing a cleaning pad to the second end of each of the cleaning pad mounting members whereby the cleaning surface of the cleaning pad moves toward the base member upon force being applied thereto to thereby conform to a shape of a surface being cleaned.

BRIEF DESCRIPTION OF THE DRAWINGS

The foregoing summary, as well as the following detailed description of the preferred embodiment, is better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DESCRIPTION OF PREFERRED EMBODIMENT

Figure 1:
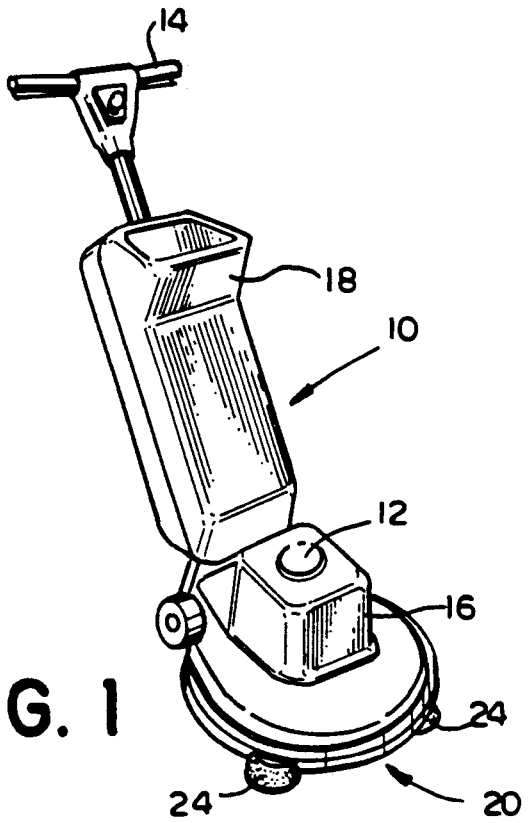
FIG. 1 is a perspective view of a typical rotary floor cleaning machine used in connection with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the cleaning disk and designated parts thereof. The terminology includes the words above specifically mentioned, derivatives thereof and words of similar import.

Referring to the drawings in detail, wherein like numerals indicate like elements throughout, there is shown in FIGS. 1–4 a preferred embodiment of a cleaning disk having cleaning pads, cleaning pad mounting members and a base member in accordance with the present invention. The term "cleaning" as used herein refers to, inter alia, polishing, restoring, scrubbing, sanding, buffing, etc.

FIG. 1 illustrates a typical rotary floor cleaning machine 10 used in connection with cleaning floors. The rotary floor cleaning machine 10 includes an electric motor 12 and a handle 14 extending at an angle upwardly toward the operator (not shown) from a motor housing 16. A holding tank 18, which contains a liquid cleaning fluid (e.g., water) or other such material, is mounted above the motor housing 16. Operatively associated with the floor cleaning machine 10 is a cleaning disk or a combination of cleaning pads, cleaning pad mounting members and a base member (generally designated 20) as described in detail hereinafter.

In the presently preferred embodiment, the rotary floor cleaning machine 10 is of the slow speed, swing type having a standard one horsepower electric motor. Such a machine is capable of receiving cleaning disks having a twelve to twenty-two inch diameter. However, it is understood by those skilled in the art, that the present invention is applicable to any type of rotary cleaning machine. For instance, the present invention could be used in connection with a mid-sized, hand-held rotary cleaning machine for cleaning marble walls or countertops or with other types of commercially available machines, such as a standard floor buffer machine.

The specific and pertinent parts of the rotary cleaning machine 10 itself are not relevant to the present invention and are understood by those skilled in the art. Thus, for convenience only, further description of the rotary cleaning machine itself is unnecessary and not limiting.

For ease of description and convenience only, the following description pertains to the use of three cleaning pads and three cleaning pad mounting members in connection with the present invention and is not limiting. It is understood by those skilled in the art, that a different number of cleaning pads or cleaning pad mounting members can be used in connection with the cleaning disk 20, without departing from the spirit and scope of the invention, as described hereinafter. However, it is also understood by those skilled in the art, that the number of cleaning pads and cleaning pad mounting members can vary so long as there is an equal number of cleaning pads and cleaning pad mounting members.

Figure 2:
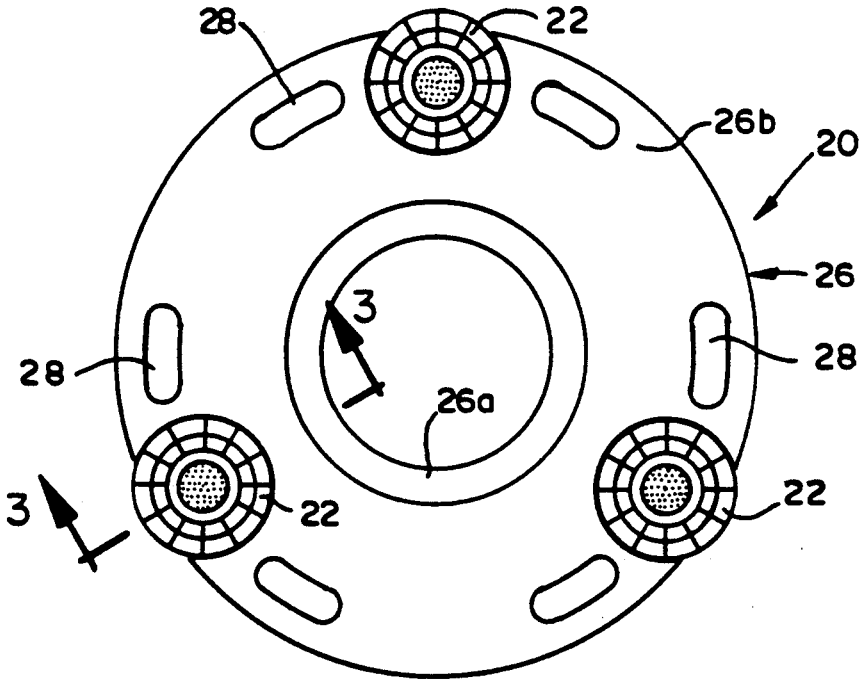
FIG. 2 is a bottom plan view of a cleaning disk having a plurality of cleaning pads, a corresponding plurality of cleaning pad mounting members and a base member in accordance with the present invention.
Figure 3:
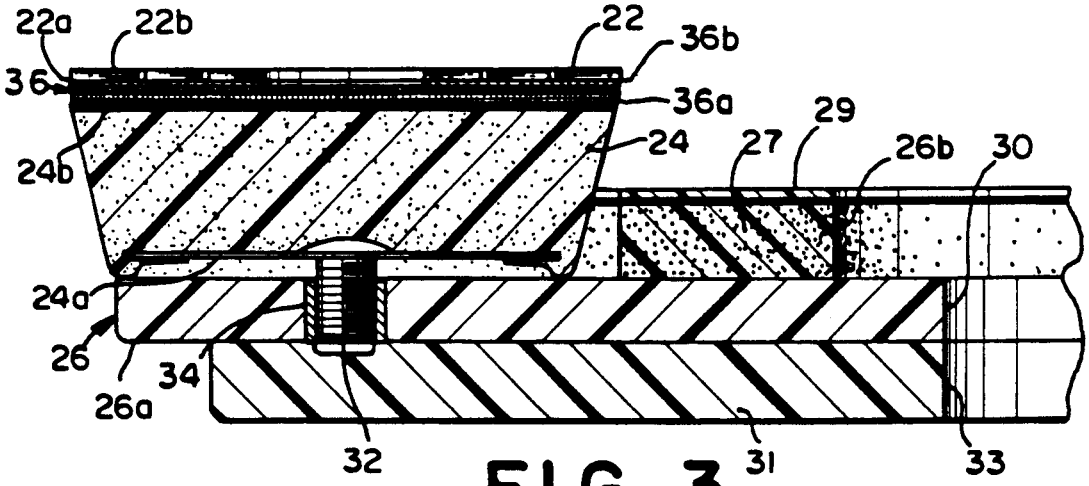
FIG. 3 is a sectional view of the cleaning disk of FIG. 2 taken along line 3—3 of FIG. 2.
Figure 4:
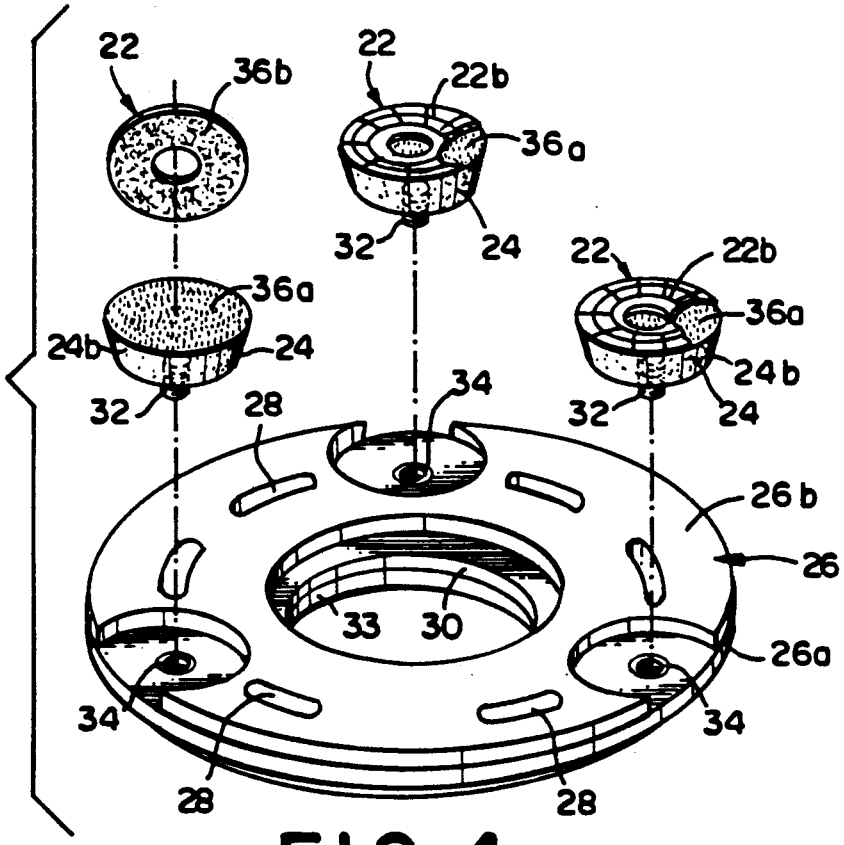
FIG. 4 is an exploded perspective view of the cleaning disk of FIG. 2 in accordance with the present invention.

Referring now to FIGS. 2, 3 and 4 a universal block or base member 26 is provided for attachment to a drive or drive shaft (not shown) of the rotary floor cleaning machine 10. Preferably, the base member 26 is generally disk-shaped with a generally circular circumference. In the presently preferred embodiment, the base member 26 is fabricated from a polymeric material with a thickness of approximately three-quarters of an inch. However, the base member 26 could be made of other high strength light weight materials, such as metal or wood and could be of any other thickness, as desired. Further, as shown in FIGS. 2 and 3, the base member 26 could include through pockets 28 for reducing the overall weight of the base member 26 as is understood by those skilled in the art.

As best shown in FIGS. 3 and 4, in the present embodiment, it is preferred that the base member 26 be constructed of an upper base member **26*a* and a lower base member 26*b* secured to and in facing relation with the upper base member 26*a*. However, it is understood by those skilled in the art, that the base member 26** could be of singlepiece construction without departing from the spirit and scope of the invention.

Preferably, the upper base member **26*a* is constructed of a lightweight high strength material for receiving the cleaning pad mounting members 24 as described hereinafter. The lower base member 26*b* is preferably constructed of an inner foam-like layer 27 and an outer plate 29 constructed of a relatively hard polymeric material for receiving a cleaning or buffing bonnet when the cleaning pad mounting members 24** are not in use, as is understood by those skilled in the art.

As shown in FIGS. 2 and 4, the upper base member **26*a* preferably includes a generally cylindrical mounting hole 30. A mounting plate 31 is secured to the upper base member 26*a* and also includes a cylindrical mounting hole 33 which complements the cylindrical mounting hole 30 of the base member 26. A riser (not shown) is preferably secured to the mounting plate 31 for securing the cleaning disk 20 to the drive shaft (not shown) of the rotary floor cleaning machine 10**.

The mounting holes 30 and 33 and riser cooperate with the drive shaft so that upon operation of the motor 12, the motor drive shaft causes the base member 26 to rotate in a manner known to those skilled in the art. The specifics of precisely how the base member 26 is secured to the rotary floor cleaning machine 10 and the specific material and construction of the base member 26 are not pertinent to the present invention and, therefore, further description thereof is omitted and is not limiting.

As shown in FIGS. 3 and 4, a plurality of generally pliable cleaning pad mounting members 24 are releasably secured to the base member 26, specifically the upper base member 26*a*. The cleaning pad mounting members each have a first end 24*a* for being releasably secured to the base member 26 and a second end 24*b* for securably receiving a cleaning pad 22 thereon.

As best shown in FIG. 2, the cleaning pad mounting members 24 are preferably positioned circumferentially and generally equidistantly spaced about the base member 26. It is further preferred that the second end 24*b* of each cleaning pad mounting member 24 extend radially beyond the circumferential edge of the base member 26 and the periphery of the rotary cleaning machine 10 to clean floor areas proximate a wall. In the preferred embodiment, the base member 26 preferably includes three cleaning pad mounting members 24. However, it is understood by those skilled in the art, that the base member 26 may include any other number of such cleaning pad mounting members 24, such as 1, 2, 3, 6 or 8. It is also understood by those skilled in the art, that the cleaning pad mounting members 24 may be positioned on the base member 26 in any other suitable array or geometrical configuration, such as octagonal and they need not be equidistantly spaced.

In the present embodiment, it is preferred that the cleaning pad mounting members 24 be constructed of a foam-like material which is readily compressible. The foam-like material preferably is of sufficient compressibility so that the second end 24*b* conforms to the shape of the surface being cleaned. It is understood by those skilled in the art, that the cleaning pad mounting members 24 could be constructed of other resiliently compressible materials, such as rubber or the like.

In the present embodiment, it is preferred that the cleaning pad mounting members 24 be generally frustoconically shaped. However, it is understood by those skilled in the art, that the cleaning pad mounting members 24 could be constructed of other geometrical configurations, such as cylindrical or triangular, without departing from the spirit and scope of the invention.

Referring now to FIGS. 3 and 4, first securing means are provided for releasably securing each of the cleaning pad mounting members 24 to the base member 26. In the present embodiment, the first securing means comprises a threaded bolt 32 extending from the first end 24*a* of each of the cleaning pad mounting members 24 and a corresponding number of complementary threaded nuts 34 anchored in the upper base member 26*a* for threadably receiving one of the bolts 32, as is understood by those skilled in the art. However, it is understood by those skilled in the art, that other means could be utilized for securing the cleaning pad mounting members 24 to the base member 26, such as a bolt extending through the center of the cleaning pad mounting member (not shown) or a snap-fit or clamping/buckling arrangement.

Referring now to FIGS. 3 and 4, there is shown a corresponding plurality of cleaning pads 22 having a mounting surface 22*a* and a cleaning surface 22*b*. A cleaning pad 22 is releasably secured to the second end 24*b* of each of the cleaning pad mounting members 24. The cleaning pads 22 are generally flexible for conforming to the flexible second end 24*b* of the cleaning pad mounting member 24. In the present embodiment, it is preferred that the cleaning pad cleaning surface 22*b* be comprised of a particulate abrasive material, such as diamond grit, which is particularly useful for cleaning marble, granite and terrazzo floors as is understood by those skilled in the art. An example of such an abrasive material is disclosed in U.S. Pat. No. 4,874,478, which is hereby incorporated by reference.

In the present embodiment, it is preferred that the cleaning disk 20 be supplied with at least two sets of cleaning pads 22 for achieving different cleaning functions. Each set includes a number of cleaning pads 22 which correspond to the number of cleaning pad mounting members 24 on the base member 26. While, the abrasive quality of the cleaning pads in each set is preferably generally the same, such as course or fine, the abrasive quality of each set of the cleaning pads 22 is preferably different. For instance, a course set of cleaning pads sand the surface of the floor for removing scratches and waxes. Whereas, a finer set of cleaning pads is used to produce a glossy crystalline finish.

Second securing means are interconnected between each of the cleaning pad mounting surfaces 22*a* and the cleaning pad mounting members second ends 24*b* for releasably securing a cleaning pad 22 to the second end 24*b* of each of the cleaning pad mounting members 24. Thus, the cleaning surface 22*b* of each cleaning pad 22 moves toward the base member 26 upon force being applied thereto to thereby conform to the shape of the floor surface being cleaned.

In the present embodiment, it is preferred that the second securing means comprise hook and loop material 36 interconnected between each cleaning pad mounting member second end 24*b* and the mounting surface 22*a* of each corresponding cleaning pad 22. Preferably, loop material 36*a* is secured to the second end 24*b* of each cleaning pad mounting member 24 and the hook material 36*b* is secured to the mounting surface 22*a* of each cleaning pad 22, as shown in FIGS. 3 and 4.

To assemble the combination 20, the cleaning pad mounting members 24 are threadably secured to the base member 26 by utilizing the bolt and nut arrangement 32, 34. A cleaning pad 22 is then secured to the second end 24*b* of each cleaning pad mounting member 24 utilizing the hook and loop material 36, as is understood by those skilled in the art. The base member 26 is then mounted on the drive shaft of the electric motor 12 in a manner known to those skilled in the art. However, depending upon the type of rotary cleaning machine 10, the base member 26 can first be mounted on the drive shaft of the electric motor 12 and then the cleaning pad mounting members 24 and cleaning pads 22 can be attached thereto.

The cleaning disk 20 is preferably used in connection with relatively hard floors, such as marble, granite or terrazzo floors. In use, it is preferred that a set of relatively course cleaning pads 22 be secured to the cleaning pad mounting members 24 to first sand the surface of the floor to remove scratches and waxes. A distinct advantage of the present invention is that the holding tank 18 merely feeds water to the floor to assist in removing the scratches and waxes. The water is not supplemented by dangerous or toxic chemicals, and yet the floor still achieves the crystalline and shiny finish. After the entire floor area is cleaned utilizing the course cleaning pads, the course cleaning pads are readily removed from the cleaning pad mounting members 24 utilizing the hook and loop material 36 and replaced with cleaning pads 22 having a fine abrasive surface. The hook and loop material 36 is particularly advantageous in combination with the pliable cleaning pad mounting members 24 to securely receive the cleaning pad 22 during the cleaning operation.

As stated above, the cleaning disk 20 of the present invention is shown with the rotary floor cleaning machine 10 for illustration purposes only, as the cleaning disk 20 can be used in conjunction with any rotary cleaning machine of this general type. Furthermore, the cleaning disk 20 or base member 26 can be of any suitable diameter to correspond to the particular cleaning machine requirements. Moreover, variations may be made in the relative size of the cleaning pad mounting members 24 and cleaning pads 22.

From the foregoing description, it can be seen that the present invention comprises a cleaning disk 20 having a base member 26, cleaning pad mounting members 24 and cleaning pads 22. It is appreciated by those skilled in the art, that changes could be made to the embodiment described above without departing from the broad inventive concept thereof. It is understood, therefore, that this invention is not limited to the particular embodiment disclosed, but is intended to cover all modifications which are within the spirit and scope of the invention as defined by the appended claims.

I claim:

1. A combination of cleaning pads, cleaning pad mounting members and base member for a rotary cleaning machine, said combination comprising:

a base member for attachment to a drive of the rotary cleaning machine;

a plurality of generally pliable cleaning pad mounting members releasably secured to said base member, said cleaning pad mounting members each having a first end for being releasably secured to said base member and a second end for securably receiving a cleaning pad thereon;

first securing means for releasably securing each of said cleaning pad mounting members to said base member, said first securing means comprising a bolt extending from said first end of each of said cleaning pad mounting members and a corresponding plurality of complementary nuts anchored in said base member for threadably receiving one of said bolts;

a corresponding plurality of cleaning pads having a mounting surface and a cleaning surface, one of said cleaning pads being releasably secured to said second end of each said cleaning pad mounting members; and second securing means interconnected between each of said cleaning pad mounting surfaces and said cleaning pad mounting member second ends for releasably securing a cleaning pad to said second end of each cleaning pad mounting member whereby the cleaning surface of said cleaning pad moves toward said base member upon force being applied thereto to thereby conform to a shape of a surface being cleaned.

2. The combination as recited in claim 1, wherein said plurality of cleaning pad mounting members, first securing means, plurality of cleaning pads, and second securing means are positioned circumferentially and are generally equidistantly spaced about said base member.

3. The combination as recited in claim 1, wherein said cleaning pad mounting members are constructed of a foam-like material which is readily compressible.

4. The combination as recited in claim 1, wherein each of said cleaning pad cleaning surfaces are comprised of particulate abrasive material.

5. The combination as recited in claim 4, wherein said particulate abrasive material is diamond grit.

6. The combination as recited in claim 1, wherein said second securing means comprises hook and loop material interconnected between each of said cleaning pad mounting member second ends and each of said cleaning pad mounting surfaces.

7. A combination of cleaning pads, cleaning pad mounting members and base member for a rotary cleaning machine, said combination comprising:

a base member for attachment to a drive of the rotary cleaning machine;

a plurality of generally pliable clearing pad mounting members releasably secured to said base member, said cleaning pad mounting members each having a first end for being releasably secured to said base member and a second end for securably receiving a cleaning pad thereon;

a first member extending from said first end of each of said cleaning pad mounting members and a corresponding plurality of complementary second members anchored in said base member for releasably receiving one of said first members and quick connect means interconnected between each of said first and second members for quickly connecting and disconnecting said first and second members;

a correspondingly plurality of cleaning pads having a mounting surface and a cleaning surface, one of said cleaning pads being releasably secured to said second end of each said cleaning pad mounting members; and securing means interconnected between each of said cleaning pad mounting surfaces and said cleaning pad mounting member second ends for releasably securing a cleaning pad to said second end of each cleaning pad mounting member whereby the cleaning surface of said cleaning pad moves toward said base member upon force being applied thereto to thereby conform to a shape of a surface being cleaned.

* * * * *